United States Patent [19]

Ford, Jr. et al.

[11] 4,445,432

[45] May 1, 1984

[54] ARTICLE DECORATING

[75] Inventors: Clarence E. Ford, Jr., Painted Post, N.Y.; Ronald E. Johnson, Tioga, Pa.

[73] Assignee: Corning Glass Works, Corning, N.Y.

[21] Appl. No.: 173,129

[22] Filed: Jul. 28, 1980

[51] Int. Cl.[3] ..... B41F 9/02

[52] U.S. Cl. ..... 101/152; 101/170; 101/175; 101/177; 101/211; 101/217

[58] Field of Search ..... 101/151, 154, 152, 175, 101/177, 36, 176, 217, 174, 426; 156/235

[56] References Cited

U.S. PATENT DOCUMENTS

| | | | |
|---|---|---|---|
| 801,088 | 10/1905 | Kammerer | 101/177 X |
| 2,208,046 | 7/1940 | Durup et al. | 101/217 |
| 2,310,788 | 2/1943 | Hummelchen | 101/350 |
| 3,255,695 | 6/1966 | Johnson et al. | 101/211 |
| 3,554,836 | 1/1971 | Steindorf | 101/177 X |
| 3,688,695 | 9/1972 | James | 101/211 |
| 3,915,087 | 10/1975 | Tiemann | 101/175 X |
| 4,261,749 | 4/1981 | Johnson | 106/23 |
| 4,280,939 | 7/1981 | Johnson | 260/23 AR |
| 4,292,104 | 9/1981 | Heimbach et al. | 101/153 X |

*Primary Examiner*—Edgar S. Burr
*Assistant Examiner*—Charles A. Pearson
*Attorney, Agent, or Firm*—John P. DeLuca

[57] ABSTRACT

A method and apparatus for applying thermoplastic decorative inks onto various substrates by printing each color ink onto a releasing surface from a heated engraved or etched metal surface, transferring by intimate mechanical contact the various colors from each releasing surface onto a second releasing collector surface to form a multi-colored print, and transferring the multi-colored print to a ceramic, glass-ceramic or glass substrate by intimate contact with the collector surface.

16 Claims, 4 Drawing Figures

FIG. 1
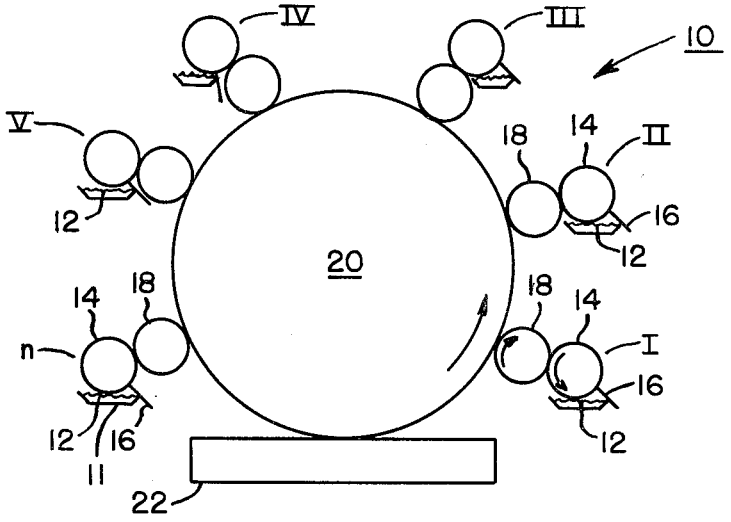
FIG. 2
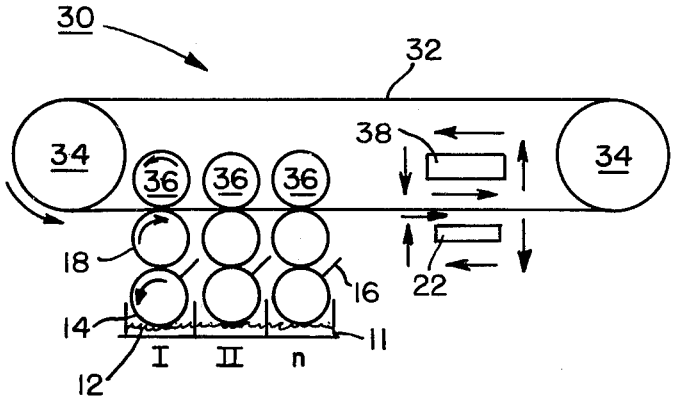
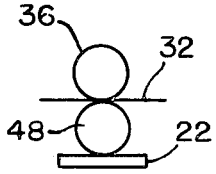
FIG. 2a
FIG. 3
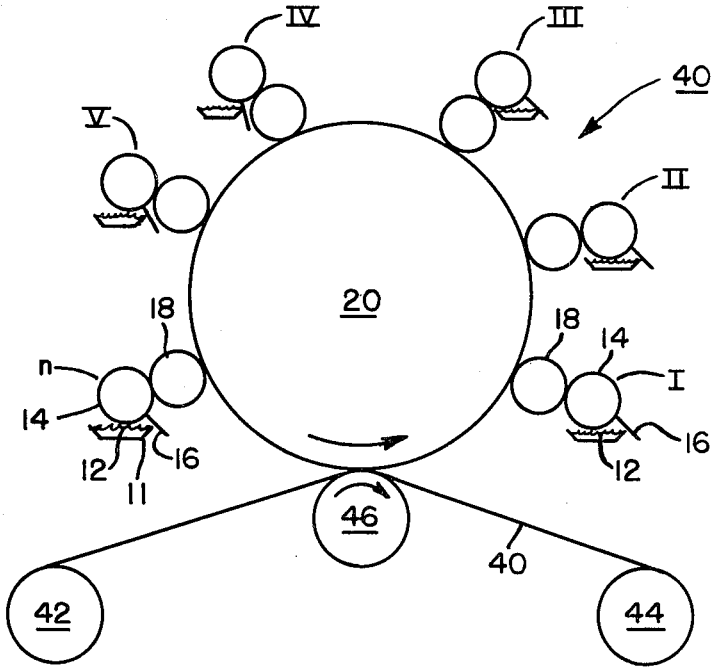

ARTICLE DECORATING

BACKGROUND OF THE INVENTION

It is well known that ceramic, glass-ceramic and glass substrates can be decorated by transfer printing from an intaglio plate or silk screen utilizing an elastomeric silicone pad or roll as a transfer member. The decorating inks utilized in these processes are organic solutions filled with an inorganic powder. The organic solutions used for decorating at high rates (3–120 decorations/minute) are primarily fast drying lacquers and enamels. These materials have a significant drawback in that the moderately fast evaporation rates of the solvents necessitate frequent viscosity adjustments in order to maintain acceptable print quality. This problem is aggravated by high levels of inorganic fillers (pigments and fluxes) which necessitate a corresponding increase in ink solvents to maintain a printable viscosity. Alleviation of this problem by reducing solvent evaporation rates necessitates a corresponding decrease in printing rate, because a specific amount of drying is required on the elastomeric surface to achieve an ink state suitable for transfer.

Normally the print dries by evaporation and solvent penetration into the silicone. After the print dries sufficiently to form a tacky film, the print is brought into intimate mechanical contact with a substrate for which the print has greater affinity. The print consequently transfers completely to the substrate, whereupon it is further dried so that a second color may be applied from a second elastomeric pad or roll to create a multi-colored decoration. In the above processes, the ware must be contacted separately by successive heads to form a multi-colored decoration.

In the process described in U.S. Pat. No. 3,255,695, an embossed type surface was utilized to deposit successive colors of film forming inks onto a collector surface. The inks are described as having a first cohesive strength level, referred to as viscosity, and a first residual surface energy level. The collector is described as having a second residual surface energy less than the ink film. Residual surface energy differences between type face and collector are not a factor in the transfer mechanism described therein, the ink being divided (split) between the two surfaces and not transferred as an integral film. The collector elastomer roll may be utilized such that the article to be printed receives a multicolored decoration in a single contact therewith. A time lag is provided between successive impressions to increase the cohesive strength of the previous impressions, thus preventing comingling of colors. In order to minimize this time lag and thereby achieve higher printing rates the collector surface would normally be heated. The cohesive strength of the ink could be increased by drying; but oxidation, polymerization, or, in the case of powders, melting could be employed. The cohesive strength of the ink continues to increase until it exceeds the adhesive strength between the ink and collector surface. The present invention differs from this prior art process both in the nature of the inks employed, and in the method of applying the inks onto the collector roll.

In the above disclosed process the ability to apply successive colors onto the collector surface is affected by the fact that the initial cohesive strength of the applied inks is less than its adhesive strength to either the collector surface or the previously applied ink layer thereon. Thus, the colors consequently split between the type and collector surfaces upon printing onto the collector. Previously applied colors do not contact any surfaces, except low cohesive strength ink, until such time that the composite colors are transferred to the surface to be printed.

The process of U.S. Pat. No. 3,255,695, represents an improvement over prior transfer printing processes in that it utilizes a heated pad to maintain fast printing rates, and a collector to transfer a multi-colored print in a single step. The process, however, is not without its disadvantages and limitations. Foremost, the process has all the inherent print quality limitations of typographic (embossed type) printing. The resolution, definition, and toning (shading) capabilities of typographic printing are inferior to other printing processes, especially lithographic and gravure processes. These limitations are very significant in terms of the kind and the quality of decorations which can be printed. Simple replacement of the embossed type application of ink onto the collector by other techniques is not possible since, the ink would transfer, upon contact, to all surfaces with higher residual surface energies. These include screens, gravure plates and offset pads made from conventional materials. Only by converting the collector itself to a typographic roll could a planar ink application surface be utilized.

A limitation not readily apparent in the process 3,255,695 patent is the inability to control print thickness. In glass decorating such control is often very important; normally, thermal expansion between the fluxes utilized in the design colors and the surface or substrate to be printed upon should be matched as closely as practicable. This is not always possible. For example glass ceramics sold by Corning Glass Works under the registered trademark PYROCERAM®, have a sufficiently low expansion such that fluxes having all the desired expansion properties are not readily available; consequently, it is important that decorations be applied with very controlled thicknesses. The fired decorations must be thin enough not to spall during thermal cycling, but thick enough to exhibit satisfactory color intensities.

Gravure processes, not available for use in the 3,688,695 process, have an advantage when decorating such substrates because of the ability to precisely control print thicknesses by accurately controlling the depth of the engraved or etched plate. The discontinuous nature of most gravure prints, due to dot toning, is also beneficial in permitting a greater tolerance for a thermal expansion mismatch.

Decorating glass also necessitates printing with ink compositions highly filled with inorganic compounds which consequently require high levels of organic solvents to maintain acceptable print viscosities. Such solvents create toxicological and environmental problems. If color content is reduced slower process speeds result, while higher solvent content creates viscosity instability, both problems are only partially overcome by the use of a heated collector surface.

The present invention maintains a fast printing rate by utilizing a solventless ink, sometimes hereinafter referred to as a hot melt or thermoplastic ink, which is applied to a transferring elastomer from a heated intaglio surface. The ink is allowed to cool on the elastomer until a tacky cohesive film, suitable for transfer, is formed. The cooling time required on the elastomeric surface usually ranges from 0.1 to 1 second.

Although the use of thermoplastic inks in conjunction with an elastomeric transfer member is disclosed in another U.S. Pat. No. 3,688,695, such thermoplastic inks are applied to the transfer member through a heated screen, and one of two methods is then employed for transferring the image from the elastomer to a substrate. According to the first of these, the substrate is sized with an adhesive which provides a high surface affinity for the thermoplastic image; the image is then transferred to the substrate from the transfer member which has been heated to a critical tack temperature just below the melt point of the ink. According to the second method, the transferring elastomer is heated above the melt point of the thermoplastic color and pressed into intimate mechanical contact with the substrate to release the image. In U.S. Pat. application Ser. No. 74,910 filed Sept. 13, 1979, now U.S. Pat. No. 4,292,104, assigned to Corning Glass Works, the assignee herein, a decal printing device was disclosed utilizing separate printing stations incorporating offset gravure and flexographic techniques in conjunction with thermoplastic inks. That system, however, did not employ a collector.

The present invention utilizes a heated intaglio surface for applying thermoplastic ink onto a first offset (transfer) surface whereupon the ink cools to form a tacky pressure-sensitive film which is subsequently transferred by intimate mechanical contact onto a second offset (collector) surface. Such a process based on multiple offset surfaces, rather than a single offset surface as in U.S. Pat. No. 3,255,695, is compatible with gravure, as well as screen and lithographic printing. The inks herein employed are permanently pressure-sensitive, such that, when cooled upon the first offset surface they can be transferred between subsequent surfaces for which they exhibit progressively increasing degrees of affinity merely by causing intimate mechanical contact. The use of such an ink allows immediate transfer of the image from the collector to the substrate, and does not require heating of either the collector or substrate. The ink also allows for immediate overprinting of colors as no time delay is required on the collector surface to effect a cohesive strength increase. Further, the use of such an ink does not require the use of a substrate sized with an organic adhesive. The elastomeric transfer members of the present invention are continuously maintained at a temperature which is less than the temperature of the ink as applied to the transfer member from a heated etched or engraved plate or roll.

Tack is incorporated into the inks for use in the present invention through specific formulations so that heating of the releasing surface is neither necessary nor desirable. The inks utilized herein exhibit the properties of pressure-sensitive thermoplastic adhesives and are unique from other thermoplastics proposed for transfer decorating, in that the inks are transferred to the substrate in a solid or semi-solid state. For a more detailed description of specific ink formulations which may be utilized, reference is directed to U.S. Pat application Ser. Nos. 74,907 and 74,909 filed Sept. 13, 1979, now U.S. Pat. Nos. 4,280,939 and 4,261,749, and assigned to Corning Glass Works the assignee herein.

Evaluation has revealed that the inks proposed for use in the present invention exhibit many advantages over solution inks such as: viscosity stability, insensitivity to printing rate changes, insensitivity to ambient conditions, toleration of wider variable ranges on virtually all of the process variables, no deterioration of print quality due to silicone saturation or solvent evaporation, toleration of irregular ware feed, faster start-ups (no breaking-in of silicone), no solvent fumes, and simultaneous printability of both fine and bold areas.

In a copending U.S. Pat. application Ser. No. 74,910 filed Sept. 13, 1979, now U.S. Pat. No. 4,292,104, assigned to Corning Glass Works, the assignee herein, a multistage offset printing apparatus was disclosed. The present invention differs from the above identified application in that all the colors are collected on a common elastomer surface prior to offset to a substrate, thereby improving registration and significantly simplifying the construction of the apparatus.

DESCRIPTION OF THE DRAWINGS

FIG. 1 is a schematic elevational view of an apparatus adapted for practicing the present invention.

FIG. 2 shows an alternative embodiment employing the teachings of the present invention.

FIG. 2*a* shows a variation of the embodiment illustrated in FIG. 2.

FIG. 3 is an apparatus similar to FIG. 1 adapted for manufacturing decals.

SUMMARY OF THE INVENTION

In accordance with the present invention there is disclosed a method and apparatus for decorating articles preferably of the glass or glass-ceramic type.

Multi-colored glass-enamel coatings are applied onto glass or glass-ceramic substrates by first printing each color separately onto a releasing collector surface, followed by a complete transfer in a single step to the glass substrate through intimate physical contact of the two surfaces. The various colors are transferred to the collector surface as glass-enamel filled thermoplastic inks by a series of printing stations consisting of an etched or engraved (intaglio) surface and a releasing elastomeric transferring (offset) surface. The multi-colored print, formed on the collector surface, can either be transferred immediately to a glass or ceramic substrate, can be transferred to a backing sheet (i.e. decal paper) and stored thereon until transfer to ware at a later time is desired, or can be transferred to ware through a series of consecutive offset surfaces for which the ink exhibits progressively increasing degrees of affinity.

In another embodiment a metal inking surface and flexographic surface can be substituted for the intaglio and offset surfaces respectively.

DESCRIPTION OF THE INVENTION

In the preferred embodiment, a heated (150°–400° F.) intaglio roll or plate is flooded with a molten thermoplastic ink. The ink is subsequently removed by a doctor blade or squeegee from the surface, leaving ink solely in the recessed etch or engraving. The intaglio surface is brought into intimate contact with a first elastomeric (offset) surface sometimes referred to hereinafter as a transfer surface, which is capable of being wetted by the molten ink. The liquid ink in the recessed etch or engraving splits between the two surfaces when the surfaces are separated, thereby creating a mirror image of the etch or engraving on the elastomeric surface. The ink immediately cools to form a tacky film on the transfer surface. The transfer surface is then brought into intimate mechanical contact with a second elastomer, hereinafter referred to as the collector, for which the ink has greater affinity; i.e., the residual surface energy of the second elastomer is higher than the first elastomeric transfer surface. Upon separation of the two elastomers, the ink is released, that is, the ink transfers as an integral film from the transfer surface to the collector.

The ink contains a polymeric resin which imparts sufficient cohesive strength thereto to effect total transfer. The cohesive strength of the ink film must exceed the bonding strength of the ink to the aforementioned elastomeric surfaces in order to maintain film integrity in both this and subsequent transfers.

A second color may then be registerably placed over and/or adjacent the first color to create a two-color print on the collector surface. The second color is transferred to the collector through intimate mechanical contact with another intaglio surface and transfer elastomer combination. Due to the difference in residual surface energies of the elastomers, the first color will not transfer back to any of the transfer elastomers upon recontact.

The above procedure may be repeated several times to form a multi-color decoration. Upon complete formation of the decoration upon the collector, it may be transferred to an article by intimate mechanical contact between the collector and a glass or ceramic substrate. The residual surface energy of the substrate must exceed that of the collector to effect total release. The transfer to the substrate can be immediate or can be delayed for an indefinite length of time.

After the multi-colored print is completed upon the collector surface, it is usually transferred to ware by causing intimate mechanical contact between the collector and ware surfaces. Optionally, however, one or more transfers between consecutive surfaces may be interposed between the collector and ware. Such additional transfers of the completed multi-colored print are sometimes desirable due to geometric considerations. For instance, if the collector is flat, it is difficult to obtain total uniform release to a flat surface because of air entrapment; consequently, the multi-colored print would be first transferred to a roll surface, and then from the roll surface to the flat ware surface. This could be effected by a third offset roll constructed of a material exhibiting intermediate affinity for the ink in relation to the collector and ware. The roll would first receive the multi-colored print by contact with the collector surface, and then release the multi-colored print to ware by contact with the ware surface.

After the final transfer, the glass or ceramic substrate is fired in a kiln or lehr at a temperature sufficient to oxidize and volatilize the organic ink constituents, leaving the glass enamels to form a firmly-attached, totally inorganic, decoration.

In order to more fully appreciate the present invention, reference is directed to FIG. 1 which is a schematic representation of at least one apparatus 10 for implementing more inking stations I-n. Since each station is virtually identical to the next, reference numerals for each are repeated throughout. In station I for example, there is provided a supply 11 of a thermoplastic ceramic-filled ink composition or ink 12 of a selected color. A heated rotatably mounted engraved intaglio roll 14 picks up the ink 12 as it rotates. A doctor blade 16 removes excess ink 12 from all but the etched or engraved impressions on the roll 14. An offset elastomeric transfer roll 18 engages the intaglio roll 14 and splits away a portion of the liquid ink remaining in the impressions in roll 14 as an integral film image (not shown). The transfer roll 18 is relatively cool and the ink image becomes a cohesive film upon contact therewith or very shortly thereafter. Elastomeric collector roll 20 engages transfer roll 18 by intimate contact as shown. The collector 20 has a greater affinity for the cohesive ink film carried by the transfer roll 18, and upon contact the image film is entirely transferred to the collector 20.

Similarly, for each supply 11 of ink 12 of various colors positioned around the collector 20 at stations II-n, the same process occurs. Each station I-n is operated in synchronism with each other so that proper registration of each portion of the design may be accomplished. Thus, each successive color of the design is registerably impressed over or adjacent the previous one. Since the collector 20 transfer rolls, the previously applied inks are not picked by the subsequent transfer rolls 18. When all of the one or more colors are applied about the periphery of the collector 20, an article or substrate 22 to be decorated is brought into intimate contact therewith, whereupon the composite of colored ink film adheres to the substrate 22. The latter has a higher affinity for the film than does the collector 20, and thus the entire decoration transfers as a cohesive film thereto.

An alternative embodiment is illustrated in FIG. 2 wherein an apparatus 30 incorporates a plurality of stations I-n each having an intaglio and transfer rolls 14 and 18, respectively, a supply 11 of ink 12, and a doctor blade 16, all of which function in a manner as previously described. In this embodiment, however, the collector is in the form of an endless belt 32 carried by rollers 34. Collector 32 engages the transfer rolls 18 as shown. Backup rolls 36 for each station I-n urge the belt 32 against transfer rolls 18, and thus intimate contact is assured so that the various colors are applied to collector 32. Downstream, a pressure pad 38 and substrate 22 each may be synchronously moved in the direction of the arrows to urge the collector belt 32 against moving substrate 22 to thereby transfer the design thereto. That is, the pressure pad 38, belt 32 and substrate 22 are in intimate contact as they move synchronously along a predetermined path. As an alternative to the use of pressure pad 38, reference is directed to FIG. *2a* wherein an applicator roll 48 could be interposed between the collector belt 32 and the substrate 22. Backup roll 36 urges the belt 32 against the applicator roll 48, and the decoration transfers to the applicator roll 48 for which it exhibits an affinity intermediate between collector 32 and substrate 22. The application roll 48 with the decoration thereon subsequently contacts the substrate 22 transferring the decoration thereto.

The apparatus 40 shown in FIG. 3 is the same as apparatus 10 shown in FIG. 1, but has been adapted for printing decals. All of the elements are the same except for the substrate upon which printing is accomplished. The collector 20 picks up the various color impressions from stations I-n as hereinbefore described and prints them onto a backing sheet 40. The backing sheet 40 is carried from respective unwind to rewind rolls 42 and 44 over backup roll 46. The transfer takes place upon contact of collector 20 with backing sheet 40 supported thereagainst by backup roll 46. The inks utilized may be any one of the types described in the aforementioned copending U.S. Pat. application Ser. Nos. 74,907, 74,909 and 74,910, now U.S. Pat. Nos. 4,280,939, 4,261,749 and 4,292,104, respectively, filed Sept. 13, 1979. The only limitation is that when printing with an ink of little or no pressure sensitivity below 40° C., such as Example 3 in U.S. Pat. application Ser. No. 74,907, now U.S. Pat. No. 4,280,939, a pressure-sensitive ink layer must be printed onto the collector superjacent to all the previously printed colors prior to transfer of the completed multicolored print to the backing sheet 40. Such a layer serves the dual function of a sealant coat for the decal and a protective overflux for the decoration as described in U.S. Pat. application Ser. No. 74,910. Since the inks and/or the sealant coat permanently retain their pressure-sensitivity, a silicone release coating is required on the back side of the decal paper to prevent adhesion between paper layers during storage.

It is within the scope of the invention that, in the embodiments described above, the following respective substitutions may be made for the intaglio roll 14 and transfer roll 18, namely, a heated inking roll and a flexographic elastomeric roll having raised impressions thereon. This arrangement will allow the printing of bold designs which have large color areas. Other apparatus for accomplishing the invention are possible, such as flat or appropriately shaped surfaces for the various functions described herein. Mechanisms other than the rolling systems may be utilized, as for example stamping devices.

In order for the transfer, collection and application of the design to be effected properly, certain materials specified below are suggested. As shown in the examples certain materials are particularly suited for each respective surface, especially when used in conjunction with the ink compositions referred to therein.

EXAMPLE 1

| Ink Preferred: S.N. 74,909 (Example 1) | | |
|---|---|---|
| Surface | Preferred Elastomer Compositions | Parts by weight |
| Transfer-18- | Dow Corning 3110 | 100 |
| | Dow Corning Catalyst #1 | 10 |
| | Polymerized 350 cs dimethyl fluid | 20 |
| Collector - 20 - Roll | Dow Corning Silastic L | 100 |
| | Silastic L curing agent | 10 |
| | Polymerized 350 cs dimethyl siloxane fluid | 40 |
| Applicator 48, interposed between collector and substrate | Dow Corning Silastic L | 100 |
| | Silastic L curing agent | 10 |
| | Polymerized 350 cs dimethyl siloxane fluid | 20 |

EXAMPLE 2

| Ink Preferred: S.N. 74,907 (Example 6) | | |
|---|---|---|
| Surface | Preferred Elastomer Compositions | Parts by Weight |
| Transfer - 18 - Roll | Dow Corning 3110 | 100 |
| | Dow Corning Catalyst #1 | 10 |
| | Polymerized 350 cs dimethyl siloxane fluid | 20 |
| Collector - 20 - Roll | SWS silicone 04478 | 100 |
| | SWS catalyst CX | 5 |
| | Polymerized 350 cs dimethyl siloxane fluid | 40 |

The elastomer compositions in all cases are mixed, deaired, and cured following established Room Temperature Vulcanization (RTV) silicone molding procedures.

Other ink compositions, such as those referred to in the above reference patent applications, may also be used in the manner described herein. The compositions listed in the Table are preferred exemplary compositions only, and should not be interpreted as limiting the scope of the invention.

It is generally desirable for the inks to cool on the transfer surface to a temperature below their ring and ball (R & B) softening point in order to be able to obtain optimum transfer. However, for inks of the type disclosed in U.S. Pat. application Ser. No. 74,909, now U.S. Pat. No. 4,261,749, which exhibit extraordinary low affinity for silicone surfaces, it is possible to obtain satisfactory transfer at temperatures near or above the ink's R & B softening point. In either case, it is highly preferable that the inks retain a high degree of pressure sensitivity within the temperature range of about 25°-65° C. in order to avoid the need for temperature control (either heating or cooling) of the transfer surface 18, collector surface 20 or the substrate 22. The liquid ink, in a low viscosity state (50-1000 poise), is applied onto the offset printing surface (usually transfer surface 18) whereupon it experiences both a viscosity and corresponding cohesive strength increase due to cooling, which when coupled with the retention of tack, enables the ink to transfer as an integral film to a second surface (collector 20).

The only heat generally applied to the transfer surfaces 18 is that which is inherently transferred from the heated intaglio surface 14 on which the liquid film originates, and consequently each successive surface to which the ink 12 is transferred is cooler than the preceding one.

In general the temperature of the offset collector 20 surface is only slightly above room temperature (30°-40° C.). This low temperature is beneficial when printing onto heat release decal paper (backing material 40 in FIG. 3) because it insures that the wax release layer will not melt during printing. A second significant advantage of single contact printing using the offset collector 20 is that, when printing decals of the type disclosed in U.S. Pat. Ser. No. 74,910, now U.S. Pat. No. 4,292,104, referred to above, the dimensional changes of the backing material 40 do not affect the registration of decoration colors since the print is first registered upon the collector 20 before transfer to the backing material 40. The printing apparatus disclosed herein obviates the need for close regulation of the temperature and/or moisture content of backing material 40 because dimensional changes thereto will not affect the preregistered decoration.

The offset collector printing apparatus disclosed especially in FIGS. 1 and 3, has the further advantages of machine simplicity and size reduction as can be appreciated from the fact that multiple stations I-n are grouped about the collector 20. Process capabilities also include, increased accuracy in color registration, faster printing speeds and increased selection, all of which contribute to the desirability of implementing the process and apparatus described herein.

What is claimed is:

1. In combination, an apparatus for printing multicolored designs on a substrate and a thermoplastic pressure sensitive ink for each color thereof comprising:

a supply of each thermoplastic ink, the supply being heated to a temperature sufficient to melt the ink, said inks containing no volatile solvents which evaporate during the movement of the inks from the ink supply to the substrate, the composition of said inks remaining substantially unchanged during the printing operation;

an inking surface for each supply of ink, the inking surface being heated to a temperature above the melting point of the ink and engaging the supply for receiving thereon a selected amount of the ink in melted form;

an elastomeric transfer surface associated with each inking surface, the transfer surface operating at a temperature below that of the associated inking surface and contacting the associated inking surface for receiving thereon selected amounts of the ink from the inking surface in the form of a pattern, the ink becoming cooled to below its melt point upon contact with the transfer surface; and an elastomeric collector surface operating at a temperature not greater than the temperature of the transfer surface, the transfer surfaces being positioned around the collector surface for contacting the same at spaced locations with synchronous movement to provide on the collector surface a total transfer of each ink pattern from each associated transfer surface in registration with the other ink patterns from the other associated transfer surfaces, to thereby form the multicolor design;

each transfer surface and the collector surface being formulated from silicone materials which exhibit progressively greater affinity for the ink but less affinity therefor than the substrate;

the ink being formulated to melt upon the application of heat and to form a cohesive film and become pressure sensitive upon cooling to below the melt point thereof, said cohesive film serving to hold said ink together to provide total transfer of said ink from the transfer surface to the collector and thence to the substrate without leaving behind any material.

2. The apparatus of claim 1 wherein the substrate is a vitreous article having a residual surface energy greater than the collector surface.

3. The apparatus of claim 1 wherein the substrate is a decal backing material having a residual surface energy greater than the collector surface.

4. The apparatus of claim 1 wherein the inking surface is a heated gravure plate.

5. The apparatus of claim 1 wherein the inking surface is a heated gravure roll.

6. The apparatus of claim 1 wherein the inking surface is a plain heated roll.

7. The apparatus of claim 1 wherein the inking surface is a plain heated plate.

8. The apparatus of claim 1 wherein the transfer surface is an elastomeric flexographic printing surface having a raised pattern thereon, for contacting the inking surface and picking up ink on the raised portions thereof.

9. The apparatus of claim 8 wherein the transfer surface is a roll.

10. The apparatus of claim 1 wherein the collector surface is an elastomeric roll and wherein each transfer surface is located circumferentially thereabout at selected spaced locations.

11. The apparatus of claim 1 wherein the transfer surface is silicone rubber.

12. The apparatus of claim 1 wherein the collector is a silicone rubber.

13. An apparatus of claim 1 wherein an elastomeric offset surface is interposed between the collector surface and the substrate surface, the interposed elastomeric offset surface having intermediate affinity for the ink between the collector and substrate such that the ink can be received from the collector upon contact and transferred to the substrate upon contact.

14. A process for producing a multicolored print comprising the steps of: providing separate sources of ink, the composition of which remains substantially unchanged during the printing operation; formulating each ink from thermoplastic media and without volatile solvents such that it becomes melted and exhibits relatively low viscosity upon application of heat and forms a cohesive pressure sensitive film upon cooling; heating each of the separate sources of ink so that they become melted; forming a separate film of each melted ink on a separate inking surface; maintaining each inking surface at a selected temperature sufficient for the ink to remain melted and achieve a relatively low viscosity state while in contact therewith; transferring a portion of said film in the form of a design from each inking surface to a separate transfer surface associated, one each, with each separate inking surface; registerably transferring each film entirely from the respective transfer surface to a collector surface by intimate mechanical contact of each transfer surface with the collector surface, such that, each of the patterns is deposited thereon to form the multicolored print; maintaining each transfer surface and the collector surface at a temperature less than the inking surface, such that, the ink becomes relatively cool upon contact with each of said transfer surface and collector surface, and thereby exhibits increased viscosity, pressure sensitivity and cohesiveness so that the inks transfer entirely from each separate transfer surface to the collector, and transferring the inks forming said multicolored print from the collector to a substrate in their entirety.

15. The process according to claim 14 further comprising the steps of: selecting various colored ink compositions and selecting the respective transfer and collector surfaces so as to exhibit respectively greater affinity for each of said inks.

16. The process according to claim 14 further comprising the step of: operating each of said aforementioned steps in registerable synchronism such that each of the thermoplastic inks is registered on the collector surface to form the multicolored print.

* * * * *

UNITED STATES PATENT AND TRADEMARK OFFICE

CERTIFICATE OF CORRECTION

PATENT NO. : 4,445,432

DATED : May 1, 1984

INVENTOR(S) : Clarence E. Ford & Ronald E. Johnson

It is certified that error appears in the above-identified patent and that said Letters Patent are hereby corrected as shown below:

Column 5, line 56, after "implementing" insert --the aforementioned process. The apparatus 10 includes one or--.

Column 6, line 15, after "20" insert --has a higher affinity for the ink impressions than the--.

Signed and Sealed this

*Thirtieth* Day of *October 1984*

[SEAL]

*Attest:*

GERALD J. MOSSINGHOFF

*Attesting Officer*

*Commissioner of Patents and Trademarks*